US006012525A

United States Patent [19]

Burleson et al.

[11] Patent Number: 6,012,525

[45] Date of Patent: Jan. 11, 2000

[54] SINGLE-TRIP PERFORATING GUN ASSEMBLY AND METHOD

[75] Inventors: John Burleson, Denton; Joe Henke, Lewisville, both of Tex.

[73] Assignee: Halliburton Energy Services, Inc., Dallas, Tex.

[21] Appl. No.: 08/978,859

[22] Filed: Nov. 26, 1997

[51] Int. Cl.[7] ..... E21B 43/11

[52] U.S. Cl. ..... 166/297; 166/55.1; 166/55.2

[58] Field of Search ..... 166/55.1, 55.2, 166/297, 278, 65.1, 298

[56] References Cited

U.S. PATENT DOCUMENTS

| | | | |
|---|---|---|---|
| 4,372,384 | 2/1983 | Kinney | 166/278 |
| 4,655,138 | 4/1987 | Regalbuto et al. . | |
| 4,667,735 | 5/1987 | Salerni et al. | 166/55.1 |
| 4,681,037 | 7/1987 | Regalbuto . | |
| 4,697,638 | 10/1987 | Knight | 166/65.1 |
| 4,753,170 | 6/1988 | Regalbuto et al. . | |
| 4,800,815 | 1/1989 | Appledorn et al. . | |
| 4,832,134 | 5/1989 | Gill . | |
| 5,259,466 | 11/1993 | Venditto et al. | 166/55.1 X |
| 5,462,117 | 10/1995 | Green et al. | 166/297 |
| 5,505,260 | 4/1996 | Andersen et al. | 166/278 |
| 5,590,723 | 1/1997 | Walker et al. . | |
| 5,603,379 | 2/1997 | Henke et al. . | |
| 5,611,401 | 3/1997 | Myers, Jr. et al. | 166/297 |

*Primary Examiner*—Frank Tsay
*Attorney, Agent, or Firm*—Paul I. Herman; John F. Booth

[57] ABSTRACT

Disclosed is an improved apparatus and method for perforating subterranean wells having a centralizer changeable from a running condition to a collapsed condition.

45 Claims, 5 Drawing Sheets

SINGLE-TRIP PERFORATING GUN ASSEMBLY AND METHOD

TECHNICAL FIELD

The present inventions relate to improvements in an apparatus used in subterranean wells and methods therefor.

BACKGROUND OF THE INVENTIONS

Perforating guns commonly used in wireline and tubing conveyed service operations for perforating subterranean oil and gas wells typically include an elongated carrier with a number of shaped charges in the carrier. Conventionally carriers are lowered in the subterranean well to a zone of interest in the formation and ignited to detonate the charges and perforate the well casing and surrounding formation. After the perforating operation is completed, a screen assembly can if needed be set in the well to control the influx of sand into the well.

In a multi-trip system, a sump packer is typically set below the zone of interest. A charge carrier is then lowered into the well to a position proximate the zone, detonated, and then removed. Thereafter, a screen assembly is installed in the well using the sump packer for proper positioning. In a single-trip system, the charge carrier is connected to the screen assembly at the screen assembly's lower end. The resulting string is lowered into the well and the charge carrier positioned adjacent the zone of interest. The charges are detonated and the carrier is then lowered through the previously installed sump packer leaving the screen supported by the sump packer in the perforated zone.

Although single-trip systems are generally less expensive to use, a problem is present regarding proper positioning of charge carriers in the casing in single-trip carrier systems. To provide maximum performance, charge carriers should be properly positioned radially in the casing at the time of detonation. Some charge are designed such that proper positioning results when the carrier is centered in the casing; in others proper positioning is present when the carrier is set off center. When charge carriers are not properly positioned radially or "centralized," the action of shape charges is diminished. In multi-trip systems positioning of the carrier is accomplished by use of mechanical centralizers. Centralizers engage the interior walls of the casing to hold the charge carrier in the proper position in the casing. However, conventional centralizers cannot be used in a single-trip system because of the restricted clearance of the sump packer. Thus, there is a need for an apparatus, which can be utilized in a single-trip system to centralize the carrier upon detonation to improve the perforation process yet allow the charge carrier to pass through a sump packer.

Another problem encountered in long carrier assemblies is detection of improper or incomplete detonation along the entire length of the carrier assembly. In single trip systems improper detonation may not be detected due to the fact that the carrier is left in the well after the attempted perforation. Thus there is a need to detect improper detonation is single trip system.

SUMMARY OF THE INVENTIONS

The present inventions relate to an improved single-trip well perforating gun apparatus and methods of using the same. The improved apparatus of the present inventions contemplate an improved tool that will properly position perforating gun carriers for detonation but will pass through the restricted clearance of a sump packer. The improved apparatus of the present inventions also provides an improved tool for use in a single trip system to detect improper detonation and methods of using the same.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples, which are illustrated and described. The various advantages and features of the present inventions will be apparent from a consideration of the drawings in which.

DETAILED DESCRIPTION

Figures 1A, 1B, 1C:
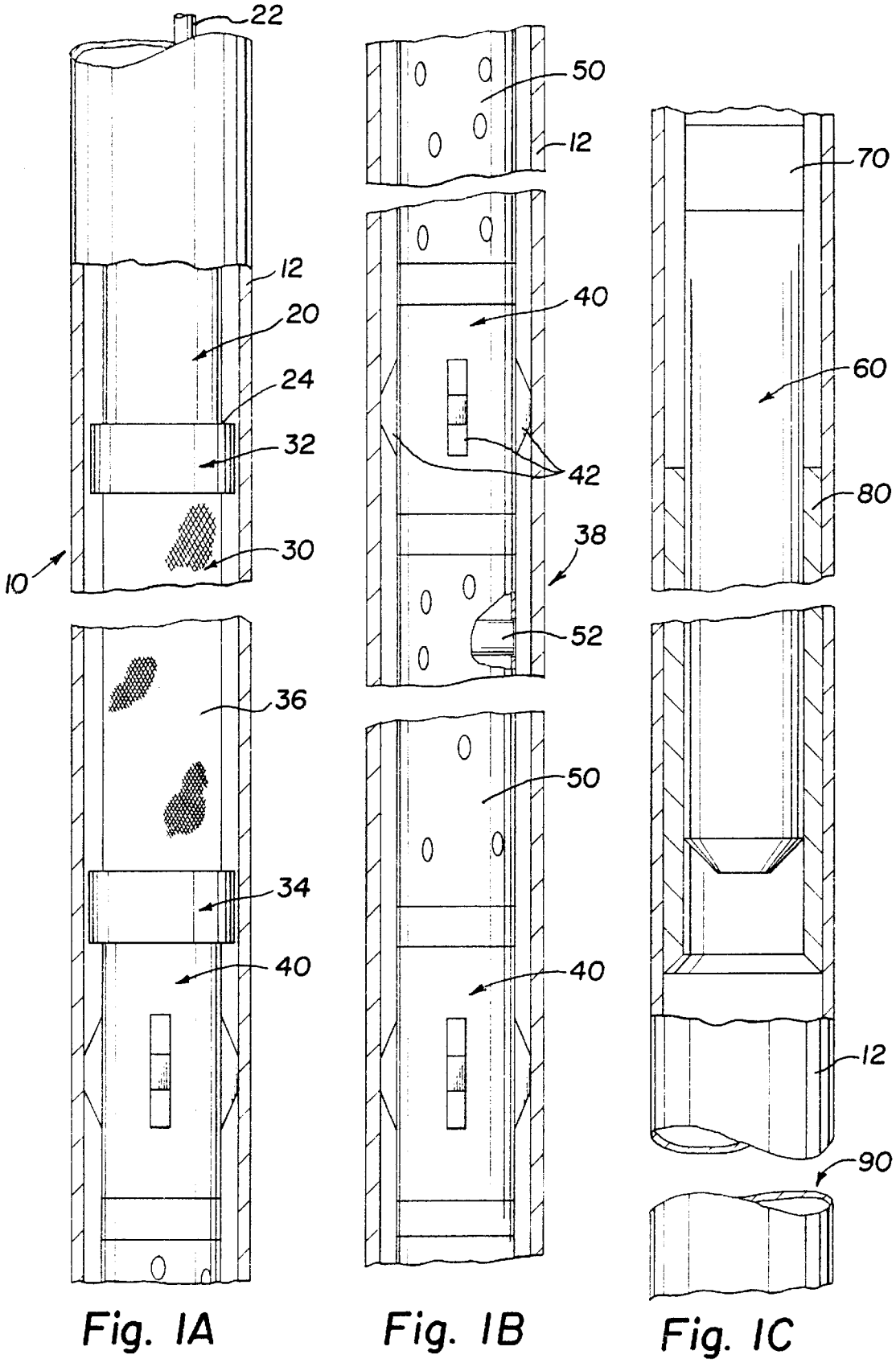
FIGS. 1*a–c* are partial sectional views illustrating schematically one example of the improved tool assembly utilizing the present inventions located in a subterranean well bore.

The present inventions are described in the following by referring to drawings of examples of how the inventions can be made and used. In these drawings reference characters are used throughout the several views to indicate like or corresponding parts. In FIGS. 1*a–c*, one embodiment of a tool assembly 10 for use in perforating a subterranean well is schematically shown in well casing 12. The tool assembly 10 includes a running tool 20, a screen assembly 30, a perforating gun assembly 38, a latch-locator assembly 60, and a bullnose 70. The components of tool assembly 10 are well known in the industry and are illustrated schematically in a tool string positioned in a subterranean cased well. In FIGS. 1*a–c* the tool assembly is positioned in the well prior to detonation of the perforation gun. The tool assembly is shown located on or supported by a sump packer 80. As is well known in the industry a sump packer is a packer typically set in the well at a point below the formation to be perforated and above the well sump 90. The sump packer is set with slips contacting the interior walls of the casing 12. Sump packers typically have a cylindrical body with an internal axially extending bore therethrough to allow access to the sump 90. The wall of the packer bore can have locking and locating slots and grooves formed therein for mating with downhole tools and the like. When installed in a cased well the sump packer presents a reduced diameter portion of the well located below the zone of interest in the well.

Running tool 20 is of the type well known in the art utilized to install and remove apparatus and assemblies from a subterranean well. The illustrated embodiment of the running tool 20 is of the type that operates with and is supported from production tubing 22. Running tool 20 is connected at 24 to a screen assembly in a manner well known in the industry. The screen assembly is shown schematically with upper and lower packers 32 and 34, respectively, and a screen material body 36 between the packers 32 and 34. Screen assembly 30 is selected to be of sufficient length to span the perforated zone. Packers 32 and 34 when operated engage the casing wall to seal off the annulus at either end of the screen assembly 30 as is well known in the art. Packer 32 has internal passageways that place the screen body in fluid communication with the production tubing 22. These passageways allow hydrocarbons to flow through the perforated casing walls, into the screens 36 and up through the tubing 22 to the surface.

Perforation gun assembly 38 is connected below the lower packer 34 and comprises a plurality of centralizers 40 and carrier assemblies 50 assembled to a sufficient length to perforate as much of the zone of interest as desired. Each centralizer 40 has pads 42 that contact the interior walls of the casing 12 to maintain the carriers 50 properly positioned radially in the casing 12. The term centralizer as used herein refers to positioning tools which contact the casing walls to radially position the tool, preferably at of near the well's centerline, although sometimes off center.

According to an aspect of the present inventions, centralizers 40 can change from a running to a collapsed condition. When in the running condition (shown in FIGS. 1*a–c*), centralizers 40 will contact the interior walls of the casing to hold the carriers 50 in proper position. When changed to a radially collapsed position, the centralizer assumes the profile equal to or smaller than the profile of the carrier 50. In the illustrated examples the charge carriers and collapsed centralizers can preferably have the same or very near the same external diameter. In any case, it is only important that the centralizers 40 collapse to size and/or shape to pass through the sump packer 80. As will be described the collapsed centralizers can pass through the bore of the sump packer along with the charge carriers.

As is well known in the industry, the shaped charge carriers 50 have a plurality of shaped charges 52 (only one of which is shown for purposes of illustration). The carrier illustrated is of the type, which has a closed body in which the shaped charges and detonation system is located. Examples of shaped charge carriers and parts thereof are shown in U.S. Pat. Nos. 4,832,134; 4,800,815; 4,681,037; 4,655,138; and 5,590,723 which are incorporated herein by reference for all purposes. When the charges are detonated, each charge forms a perforation in the carrier wall, casing and surrounding production zone of interest. Prior to detonation the interior of the carriers are closed off from the well fluids. Shaped charges are each connected to primer cords extending the length of the perforation gun assembly. In some embodiments a central passageways extend through the length of the gun assembly. Primer cords are placed in the central passageway and a detonator or initiator (not shown) is mounted at one end of the cord. In the preferred embodiment the detonator is at the upper end of the cord. The detonator is used to fire or set off the primer cord. As the detonation cord burns it sets off or detonates the shaped charges 52. Due to the high burn rate of the detonation cord, the firing or detonation of the individual charges is almost instantaneous or effectively simultaneous, in that, the initiation of the individual shaped charges are milliseconds apart.

A latch-locator assembly 60 is attached to the lowermost end of the perforation gun assembly 38. Latch-locator 60 is of the type that can releasably engage the sump packer as is well known in the industry. The latch-locator 60 has a bullnose 70, which closes off the lower end of the perforation gun assembly. As is well known in the art the latch locator assembly 60 is releasably connected to and supported by sump packer 80.

The tool assembly or string illustrated in FIGS. 1*a–c* is used in the improved single-trip method of the present inventions. To perform this method, sump packer 80 is set in the well at the proper location so that it can later be used or engaged by the latch-locator 60 to support the perforation gun assembly at the desired location. The string is assembled with the screen assembly 30 positioned above the perforation gun assembly 38. The latch-locator 60 and bullnose 70 are attached to the lower end of the string. The string is run into the well until the latch-locator 60 engages the sump packer 80. It is noted that the sump packer 80 has a reduced internal diameter or internal profile in which the latch locator 60 sets. Shaped charges 52 on the carrier are detonated to perforate the casing 12 and surrounding formations. While the detonation occurs, centralizers 40 hold the carriers in a proper radial position in the well, thus, enhancing the effect of the shaped charges in the perforation process.

According to a particular aspect of the present inventions, the centralizers 40 are of the type that will collapse to a profile or size, which will pass through the sump packer 80. In some embodiments of the present inventions, the centralizers 40 are operably connected to the detonation mechanisms of the carriers and the collapsing of the centralizers 40 is instantaneous in the sense that its collapse is a direct result of action of the firing process of the perforating gun assembly. In other embodiments the centralizer collapses as a result of its engagement with the sump packer 80. The embodiments shown and described above are only exemplary. It is envisioned that one or more of the various embodiments of the centralizers of the present inventions shown and described herein could be mixed in a single tool string as desired.

Once the perforation step is completed, the carrier and centralizer assembly is moved through the sump packer into the sump 90. This movement places the screen assembly adjacent to the perforated zone and the packers 32 and 34 are set to seal off the annulus above and below the formation zone of interest. Thereafter, the perforation gun assemblies and centralizers are left in the well below the sump packer and production from the well can begin. If detonation of the charges is incomplete the centralizers would not have collapsed and movement of the tool string down through the reduced diameter of the sump packer would be prevented. The inability to move the assembly downward is a direct indicator that detonation has in some way failed and that further analysis and possible remedial action is required.

Figure 2:
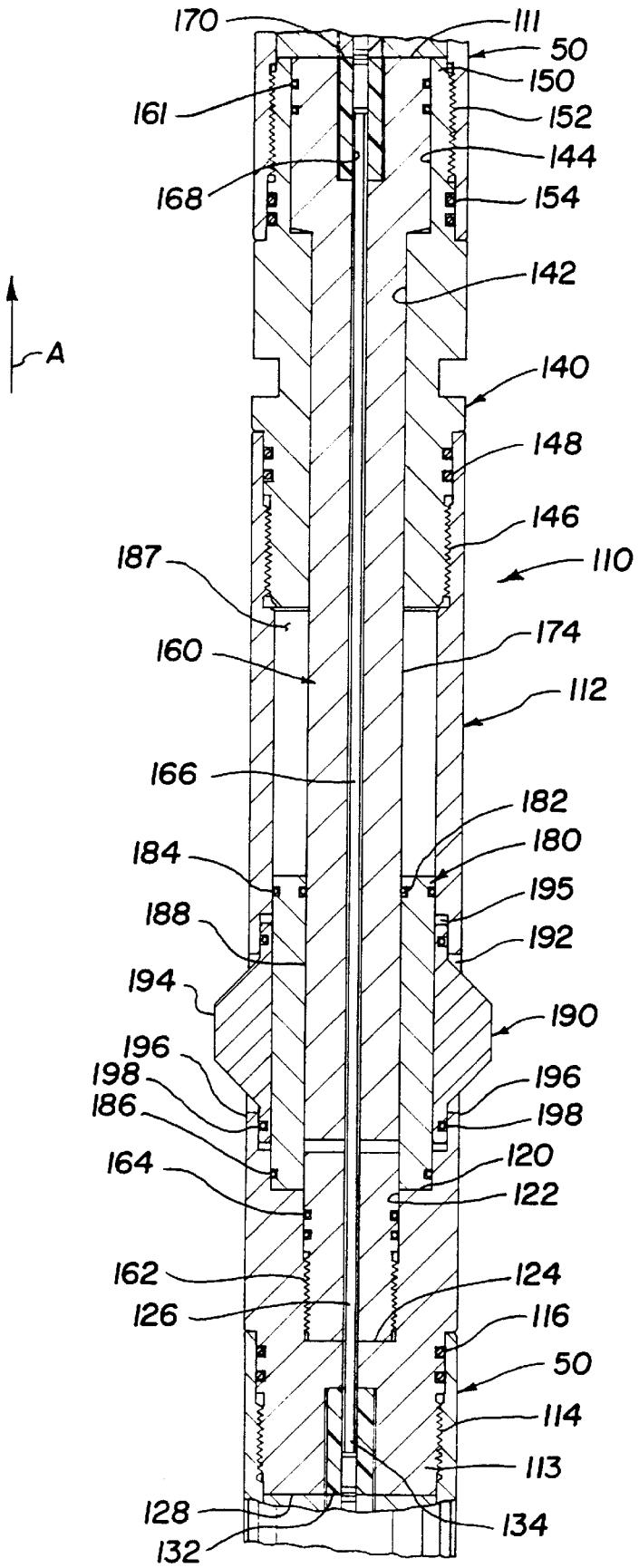
FIG. 2 is a sectional view of one embodiment of an improved centralizer of the present inventions illustrated in the running condition.
Figure 3:
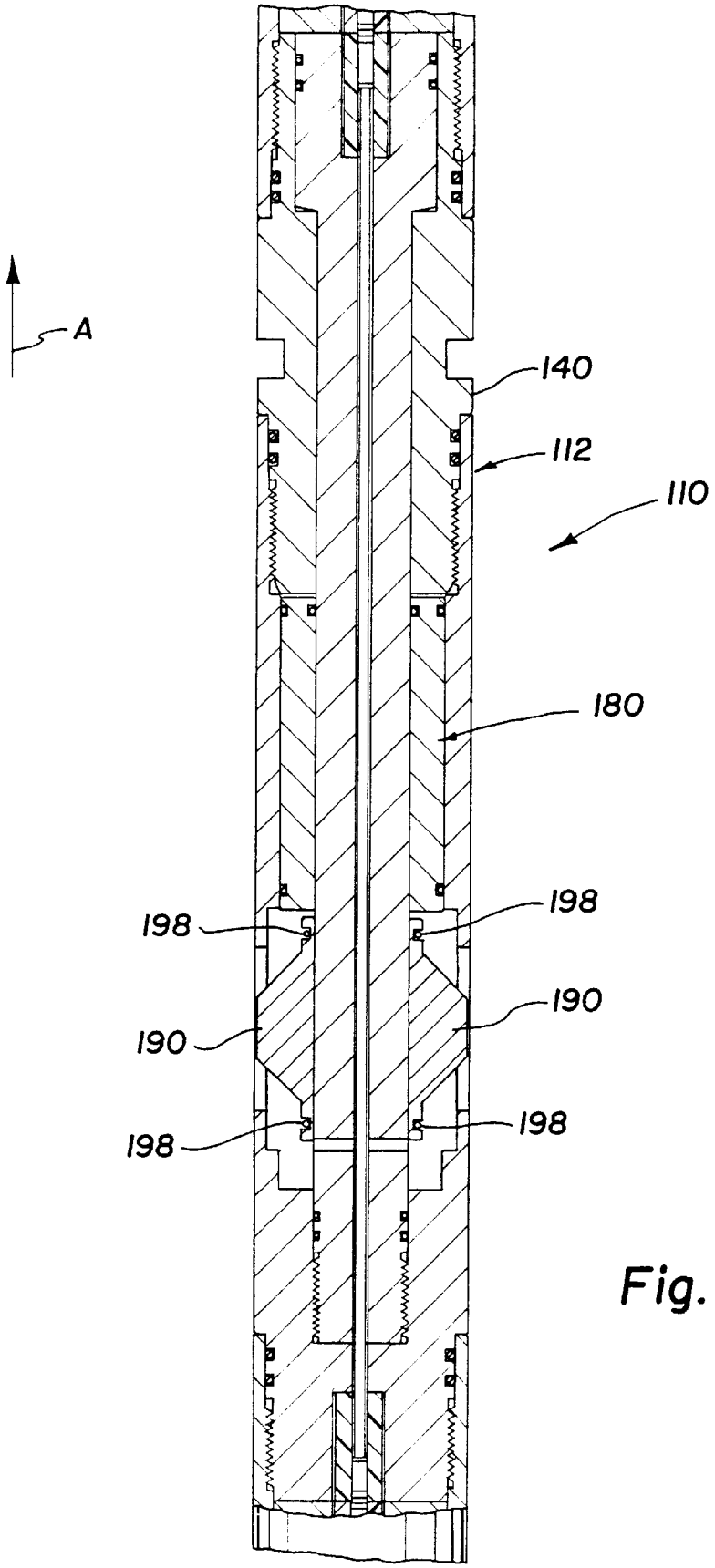
FIG. 3 is a sectional view of the centralizer of FIG. 2 illustrated in the retracted condition.

In FIGS. 2–5 three separate embodiments for centralizer 40 are shown. In the first embodiment, illustrated in FIGS. 2 and 3, the centralizer is generally identified by reference numeral 110. In FIG. 2 the centralizer 110 is in the running condition. In FIG. 3 it is in the collapsed or stowed position. Centralizer 110 is operably associated with the firing system of the perforating gun and is automatically or instantaneously collapsed by the detonation process.

In FIG. 2, centralizer 110 is illustrated with the upper or uphole end 111 being located in the uphole direction represented by arrow A. Although wells are not always positioned vertically the direction up or uphole is used to refer to the pathway or direction out of the well. Centralizer 110 has a cylindrical body 112 at the lower end 113 and an end cap 140 at the upper end. The lower or downhole end 113 of the cylindrical body 112 is necked down to a reduced diameter. External threads 114 are provided on end 113 for threaded connection into a perforation gun assembly 50. Although the body 112 is shown in threaded connection with a carrier 50 it is to be understood that adapters and spacers can be used between the centralizers 110 and the carriers 50. Seals 116 are mounted in grooves in the lower end 113 for mating with sealing surfaces in carrier 50 for sealing the connection between the carrier 50 and the centralizer 110. Seals 116 referred to herein and elsewhere are preferably annular resilient seals, however packing of even sealed threads could be used to seal the joint as is well known in the art.

An axially extending cylindrical bore 118 is formed in the cylindrical body 112 with the open end of the bore extending upward. The lowermost end of the bore 118 terminates at an interior annular end wall 120. A reduced-diameter bore 122 extends in a downhole direction from wall 120 and to a smaller annular end wall 124. Bore 122 is internally threaded. A primer cord passageway 126 extends from the wall 124 through the portion 113 of body 112. An enlarged diameter counter bore 130 is formed in the end 128 coaxial with the primer cord bore 126. A plastic sleeve 132 in bore 130 terminates the lower end of the primer cord 134 and seals the primer cord passageway. As is known in the industry, a primer cord booster can be located in sleeve 132 to ignite a similar booster located in carrier 50. In this manner lengths of primer cord can be connected together for firing through adjacent tools. It is to be understood that a conventional primer cord connection system can be used in the centralizers of the present inventions. Also, sections can be connected together with bi-directional explosive transfers as shown and described in U.S. Pat. No. 5,603,379 which is incorporated herein by reference.

End cap 140 has an axial bore 142 extending there through. An enlarged counter bore portion 144 is formed at its uppermost end of bore 142. End cap 140 has a reduced or necked down portion threaded at 146. These threads 146 mate with internal threads in bore 118 to connect the end cap 140 to the cylindrical body 112. Annular seals 148 mounted in grooves in the end cap 140 seal this connection. The uppermost end 150 of the end cap 140 is provided with external threads 152 and annular seals 154 in grooves. Threads 152 and seals 154 are utilized to connect the uppermost end 111 of the centralizer 110 to a carrier 50.

A cylindrical spool 160 is mounted in the enlarged bore 144. Annular seals 161 mounted in grooves in the upper end of spool 160 seal the annulus between the spool and the wall of bore 144. The lower end of the spool 160 is externally threaded at 162 and mates with internal threads in the reduced diameter bore 122 of the cylindrical body 112. A plurality of annular seals 164 are carried in grooves on the lower end of spool 160 to seal against the interior wall of bore 122. A central passageway or bore 166 extends through the spool 160. Bore 166 is aligned with the passageway 126 in the lower end of cylindrical body 112. Bore 166 is of a size and shape to receive primer cord 134 therein. The upper end 166 of the spool 160 has an enlarged diameter bore 168 coaxial with and in communication with the bore 166. Plastic sleeve 170 fits into bore 168 to terminate the upper end of the primer cord 134. A transverse or radially extending bore 172 is formed in the lower end of the spool 160. Bore 172 intersects with and is in fluid communication with bore 166. Preferably, the outer surface 174 of the portion of the spool extending through bore 118 is cylindrical and forms a sealing surface as will be described hereinafter.

An annular piston 180 is positioned around the spool 160 in chamber 187. Piston 180 is mounted to slide in an axial direction along the surface 174 in the forward and reverse direction or arrow A. Piston 180 is provided with internal annular sliding seals 182 to seal the annulus between the internal diameter of the piston 180 and the surface 174. External seals 184 are provided in grooves on the piston to provide sliding seals for the annulus between the piston 180 and the wall of bore 118. An annular seal 186 mounted in a groove in the lower end of piston 180 seals the annular space between the piston 180 and the wall of the bore 118.

When in the running position (FIG. 2), piston 180 is at the lower end of bore 118 against the end wall 120. A sealed chamber is formed above the piston by seals 148, 161, 182, and 184. The bottom or lower end of the piston 180 is in fluid communication with the sealed primer cord passageway 166. This communication is accomplished through bore 172 and the annulus between surface 174 and the interior diameter of piston 180. Seals 182 and 186 seal off the primer cord passageway.

Each centralizer 110 has at least one pad 190 radially extending from the periphery thereof. Pads 190 are mounted in slots 192 formed in body 112. Pads 190 have an outer surface 194 for contacting the interior of the cylindrical walls of casing 12. Contact with the casing walls properly positions the centralizer within the casing. In the running position shown in FIG. 2, the pads 190 are captured between the external surface 188 of the piston 180 and a groove or enlarged diameter portion 195 formed in the wall of bore 118. Flanges 196 are formed on the upper and lower ends of the pads 190. The axial extent of slots 192 is less than the overall axial length of the pads 190. Flanges 196 prevent the pads 190 from moving in an outward direction. Inward movement is prevented by contact with piston 180. In other words, the flanges 196 are trapped between the interior wall of the groove 195 and the exterior wall 188 of the piston 180.

Each of the flanges 196 engages an upper and lower tension spring 198 and 199, respectively. These springs extend circumferentially and sit in grooves formed in flanges 196 as shown. As will be described, the tension springs 198 assist in retracting and collapsing the pads 190 in an inward radial direction when the piston 180 is moved out of the way.

In FIG. 3 centralizer 110 is shown in its collapsed or retracted condition. In this Figure piston 180 has been moved in the direction of arrow A from a position under the pads 190 to a position allowing the pads to collapse or retract inwardly. Collapsing is accomplished when the primer cord 134 is detonated and gas and well bore pressures cause the piston to move from the position of FIG. 2 to the position of FIG. 3. As the primer cord 134 burns or is ignited gasses generated from that detonation raise the internal pressures in the passageway 166. The increased pressure is in turn communicated to the radial bore 172. Since bore 172 is in communication with the lower end of the piston, the piston is caused to move in an upward direction compressing the gas trapped in chamber 187. As the piston moves upward, seal 186 reaches the slots 192, thus, opening the lower end of the piston to well bore pressures. As those in the art will appreciate, well bore pressures will, likewise, be communicated to the passageway 166 by the detonation of the shaped charges. The presence of well bore pressures below the piston will further assist in the movement of the piston. The differential pressure across the piston 180 will cause the piston to move from the position shown in FIG. 2 to the position shown in FIG. 3. Once the piston moves to the position shown in FIG. 3 clear of the pads 190, tension springs 198 retract the pads 190 to the position shown in FIG. 3. In this retracted or collapsed condition, the centralizer assumes the profile of the charge carriers and will pass through the sump packer to provide a single-trip perforation system described by reference to FIG. 1.

Figure 4:
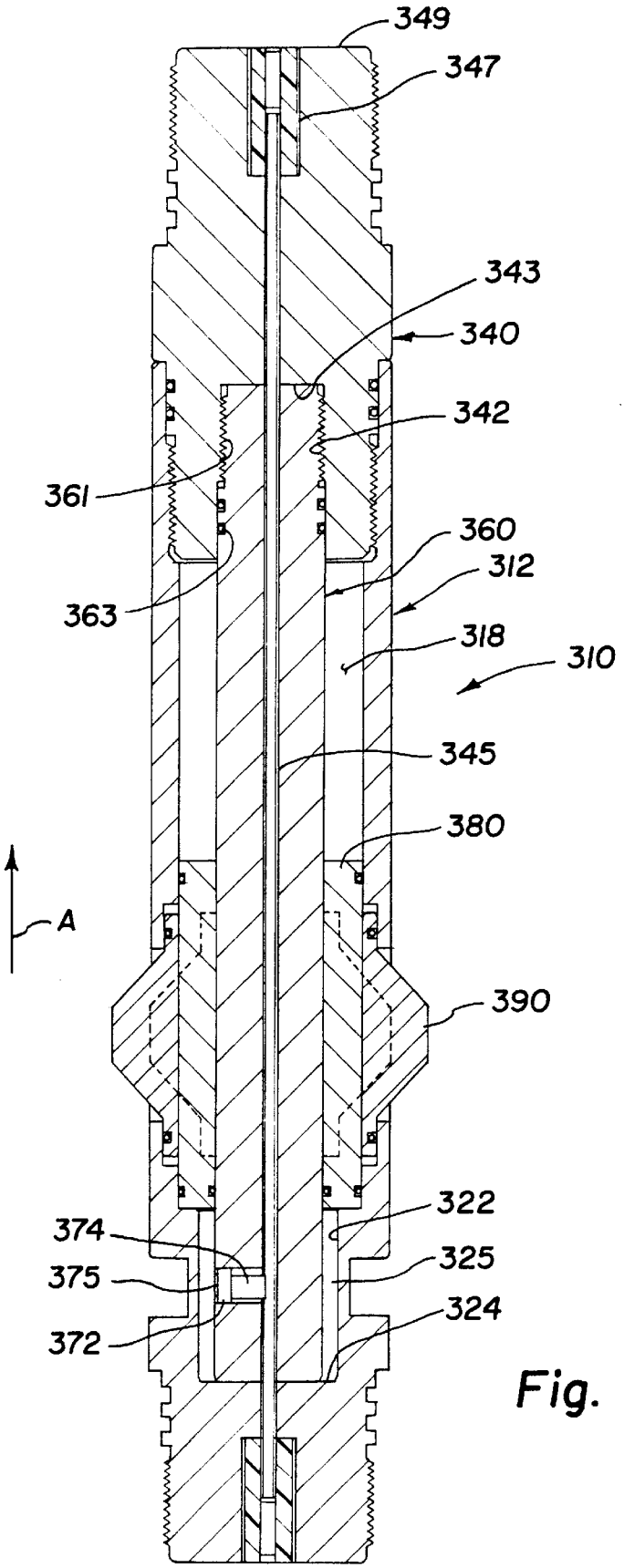
FIG. 4 is a sectional view of a second embodiment of an improved centralizer of the present inventions illustrated in the running condition.

In FIG. 4 a second embodiment of the centralizer is shown and is generally designated by reference numeral 310. In this embodiment the cylindrical body 312 with internal bore 318 is basically the same as the embodiment shown in FIGS. 2 and 3. However, the end cap 340 and spool 360 have a different configuration from those of FIGS. 2 and 3. The internal enlarged bore 342 of end cap 340 terminates at an end wall 343. A primer cord passageway 345 extends upward from end wall 343. An enlarged diameter counter bore 347 terminates the primer cord passageway 345 at end wall 349.

In this embodiment, spool 360 is cylindrical shaped with its upper end in threaded engagement at 361 with the internal threads in the bore 342. Seals 363 seal the annulus between the spool 360 and bore 342. The lower end of the spool 360 rests against end wall 324 and has a smaller diameter than the bore 322 to form an annulus 325. Piston 380 and the centralizer pads 390 are basically the same as in FIGS. 2 and 3. The spool 360 has a transverse bore 372 in which is mounted a small shaped charge 374. Bore 372 is sealed with a cap 375. The shaped charge 374 and cap 375 blocks or closes the bore 372. In operation the primer cord in passageway 345 ignites the shaped charge 374 to perforate or remove cap 375 causing a pressure surge below piston 380. The piston moves in the upward direction of arrow A. Movement of the piston frees the pads 390 to collapse in the same manner as described in FIGS. 2 and 3.

According to another feature of the present inventions the centralizer embodiment of FIG. 4 can be placed in the perforation gun assembly preferably at the end of the primer cord and used as a no-go tool. This configuration is represented by the centralizer positioned between the latch-locator and the lowermost charge carrier in FIG. 1. This centralizer is of the type which has one or more radial protrusions that are retracted or collapsed by the firing of the primer cord. Should the perforating gun assembly misfire or fire incompletely then the centralizer would not collapse because the firing sequence would not reach this lowermost centralizer. The failure of this centralizer to collapse will act as an indicator that detonation was not completely successful because the string will not move into and through the sump packer. It is believed that the centralizer could act as a no-go test for complete firing of the perforation gun assembly. When the centralizer does not collapse the string could be removed from the well and examined to determine what remedial action is required prior to production. If the centralizer does not collapse the single trip process should be repleted. When used only as a no-go tool the term centralizer may be overly limiting, in that, the no-go tool need not perform a radial locating function. It is only important that the tool change shape, size, or configuration so that it will pass through or by a restriction in the well bore. Thus when the tool is used as a indictor it need not be symmetrical nor perform a radial positioning function. However, when desired the tool can provide both the radial locating function and the no-go function.

Figure 5:
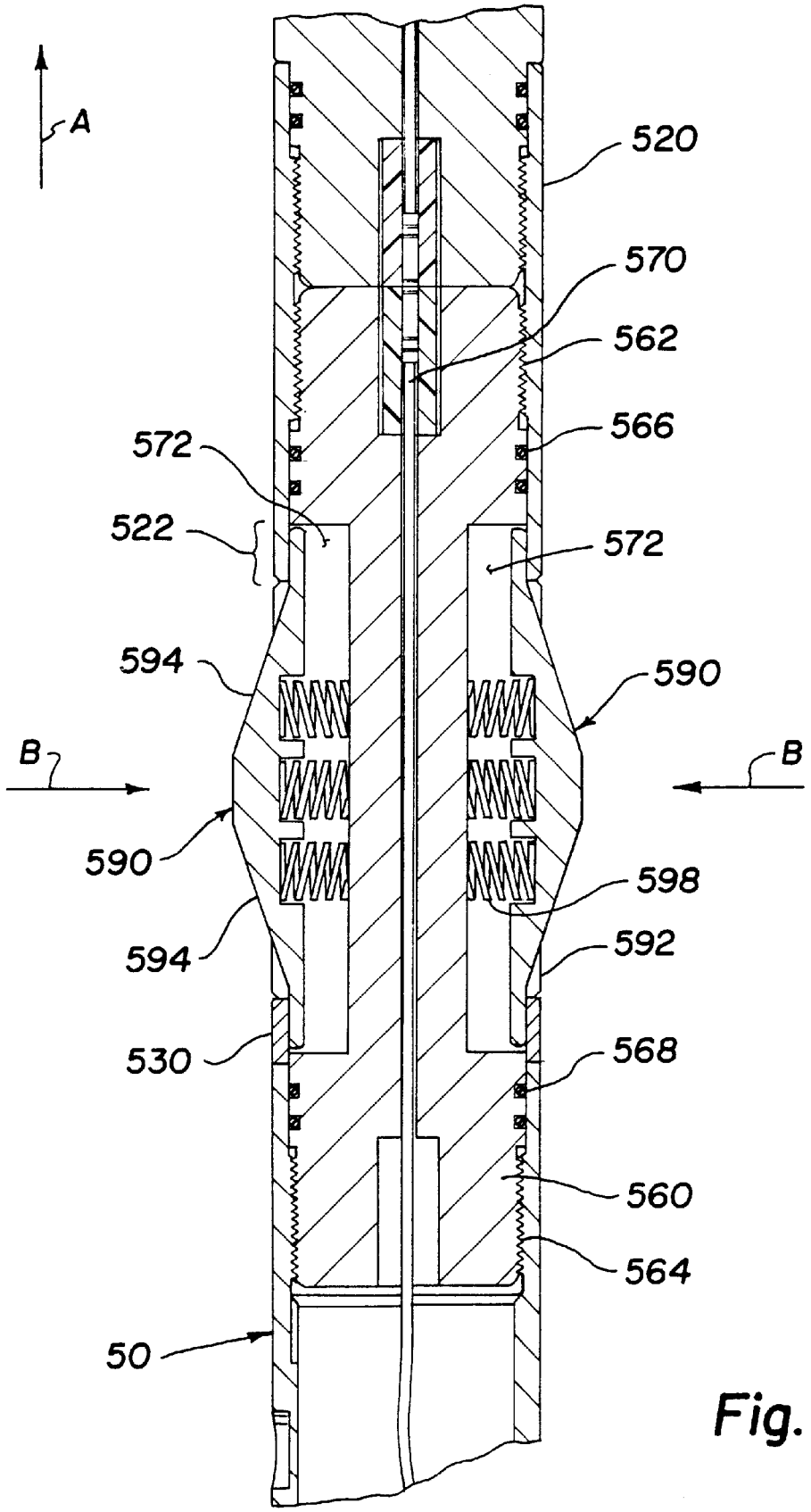
FIG. 5 is a sectional view of another embodiment of the present inventions.

In FIG. 5 a third embodiment of a collapsible centralizer 510 is shown. In FIG. 5 the spool 560 is cylindrical in shape and has upper and lower external threads 562 and 564 formed thereon. Annular seals 566 and 568 are mounted in grooves on the upper and lower ends of the spool 560. Spool 560 has a primer cord bore 570 extending there through. A plurality of axially extending slots 572 is formed in the outside of the spool 560. These slots 572 are circumferentially spaced around the external surface of spool 560. Internally threaded cylindrical sleeve 520 is threaded onto the upper end of the spool 560. The sleeve 520 engages threads 562 and provides a sealed surface for seals 566. As illustrated in FIG. 5, the sleeve 520 has sufficient axial length to extend axially over a portion 522 of the upper ends of the slots 572. A cylindrical sleeve 530 is mounted on the outside of spool 560 and overlaps a portion of the lower end of slots 572 as shown in FIG. 5.

Centralizer pads 590 are mounted in slots 572. Compression springs 598 keep the centralizer pads 590 in the radially extended position shown in FIG. 5. The lower end of the spool 560 can be threaded into a carrier assembly 50. Carrier abuts the sleeve 530 to hold the same in an axial position.

In operation the centralizer of FIG. 5 is made up in the perforating gun string and once the perforating step is completed the centralizer is moved downward until it contacts the sump packer. The tapered surfaces 594 engage the sump packer and cause the pads 590 to collapse in a radial inward direction illustrated by arrows B. This allows the centralizer to move into and through the sump packer in a single-trip system. When it is desired to remove the assembly back through the sump packer, the upper tapered surfaces 594, causes the centralizer to collapse radially to pass through the sump packer. An advantage of the centralizers of FIG. 5 is that they will allow perforating gun assemblies to pass through restrictions in the casing and still position the guns at the zone of interest for optimum performance. This restriction may be due to many things including damaged pipe, different weights of casing, casing patches, nipples, packers, etc. Still another advantage is present in fishing operations. The perforating gun assemblies can be washed over with the fishing tool without the necessity of milling off centralizer pads. The tapered surfaces 594 will cause the pads 590 to collapse as the washpipe is moved down over them.

Another application for the centralizers of the present inventions would be to use the centralizers as a locator mechanism to laterally position the perforating gun assemblies. If a restriction or a profile for the centralizer pads is provided at a known depth, the perforating guns can be positioned across the zone of interest by using the restriction or profile as the reference depth. This would eliminate the need to make a special wireline correlation run to position the perforating guns.

Many details are often found in the art such as: packers, bullnoses, shaped charges, charge carriers, screen assemblies, running tools, latches and locators. Therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts thereof within the principles of the inventions to the full extent indicated by the broad general meaning of the terms used the attached claims.

The restrictive description and drawings of the specific examples above do not point out what an infringement of this patent would be but are to provide at least one explanation of how to make and use the inventions. The limits of the inventions and the bounds of the patent protection are measured by and defined in the following claims:

What is claimed:

1. Method of perforating the subterranean formation of a lateral zone of interest in a cased well with a perforating gun assembly wherein the well casing has a restricted bore in the casing below the zone comprising the steps of:

assembling a perforating gun assembly that will pass through the casing but will not pass through the restricted bore;

laterally positioning the perforating gun assembly in the well adjacent to the zone;

radially positioning the perforating gun assembly in the casing;

initiating the perforating gun assembly to perforate the zone while simultaneously centralizing the perforating gun assembly; and collapsing the perforating gun assembly to a size to pass through the restricted bore; and moving the collapsed gun assembly through the restricted bore to a position below the perforated zone.

2. The method of claim 1 additionally comprising the step of connecting a screen assembly to the perforating gun assembly before the gun assembly is laterally positioned in the well.

3. The method of claim 1 wherein the lateral positioning step comprises connecting the perforating gun assembly to tubing and lowering tubing and assembly into the well.

4. The method of claim 1 wherein the radial positioning step comprises centralizing the gun in the casing.

5. The method of claim 1 wherein the radial positioning step comprises contacting the walls of the cased well.

6. The method of claim 1 additionally comprising the step of setting a packer below the zone prior to perforation of the zone.

7. The method of claim 1 wherein the perforation gun assembling step additionally comprises assembling a locator on the perforating gun assembly and laterally positioning the perforating gun in the well by contacting the packer with the locator.

8. Method of perforating the subterranean formation of a lateral zone of interest in a cased well with a perforating gun assembly wherein the well casing has a restricted bore in the casing below the formation comprising the steps of:

assembling a perforating gun assembly including at least one centralizer with a diameter which will not pass through the restricted bore to centralize the perforating gun assembly in the casing;

positioning the perforating gun assembly in the well adjacent to the formation;

centralizing the perforating gun assembly in the casing;

initiating the perforating gun assembly to perforate the formation while simultaneously centralizing the perforating gun assembly; and collapsing the centralizer to a size, which will pass through the restricted, bore; and moving the collapsed gun assembly through the restricted bore to a position below the perforated formation.

9. The method of claim 8 additionally comprising the step of connecting a screen assembly to the perforating gun assembly before the gun assembly is laterally positioned in the well.

10. The method of claim 8 wherein the perforating gun positioning step comprises connecting the perforating gun assembly to tubing and lowering tubing and assembly into the well.

11. The method of claim 8 wherein the perforating gun positioning step comprises contacting the walls of the cased well.

12. The method of claim 8 additionally comprising the step of setting a packer below the formation prior to perforation of the formation.

13. The method of claim 8 wherein the perforation gun assembling step additionally comprises assembling a locator on the perforating gun assembly and laterally positioning the perforating gun in the well by contacting the packer with the locator.

14. A method of perforating the subterranean formation of a lateral zone of interest in a cased well with a perforating gun assembly wherein the well casing has a restricted bore in the casing below the formation comprising the steps of:

assembling a perforating gun assembly having a perforating gun of a size shape to pass through the casing and the restricted bore;

assembling a tool on the perforating gun at the lower end of the pertorating gun, the tool being changeable from a first condition wherein the tool will pass through the casing bore but will not pass through the restricted bore and a second condition wherein the tool will pass through the casing bore and the restricted bore;

changing the tool to the first condition;

positioning the perforating gun assembly in the well laterally adjacent to the formation by contacting the restricted bore;

initiating the perforating gun assembly to perforate the formation;

changing the tool to the second condition; and moving the perforating gun and tool down through the restricted bore.

15. The method of claim 14 additionally comprising the step of connecting a screen assembly to the perforating gun assembly before the gun assembly is laterally positioned in the well.

16. The method of claim 14 wherein the lateral positioning step comprises connecting the perforating gun assembly to tubing and lowering tubing and assembly into the well.

17. The method of claim 14 additionally comprising the step of setting a packer below the formation prior to perforation of the formation.

18. The method of claim 14 wherein the perforation gun assembling step additionally comprises assembling a locator on the perforating gun assembly and laterally positioning the perforating gun in the well by contacting the packer with the locator.

19. The method of claim 14 wherein the stop of assembling a tool on the perforating gun comprises assembling a centralizer on the perforating gun.

20. The method of claim 14 additionally comprising the step of centralizing the perforating gun assembly in the well casing during the initiating step.

21. The method of claim 14 additionally comprising the step of radially positioning the perforating gun assembly in the well during the initiating step.

22. A method of perforating the subterranean formation of a lateral zone of interest in a cased well with a perforating gun assembly wherein the well casing has a discontinuous surface in the casing, comprising the steps of:

assembling a perforating gun assembly having a perforating gun of a size shape to pass through the casing and the discontinuous surface in the casing;

providing a tool having an external surface thereon changeable from a first condition wherein the tool will pass through the casing bore but the external surface will interact with the discontinuous surface in the casing and a second condition wherein the tool will pass through the casing bore and the discontinuous surface in the casing without the external surface on the tool interacting with the discontinuous surface in the casing and an actuator on the tool operable in response to initiation of the perforating gun to change the tool from the first condition to the second condition;

assembling a tool on the perforating gun;

changing the tool to the first condition;

positioning the perforating gun assembly in the well adjacent to the formation;

initiating the perforating gun assembly to perforate the formation and operating the actuator in response to the perforating gun initiation to change the tool to the second condition; and moving the perforating gun through the discontinuous surface in the casing.

23. The method of claim 22 wherein the tool is a centralizer and wherein the changeable surface moves radially between a first position contacting the walls of the casing to centralize the tool and a second position wherein the movable part radially spaced inward from the first position.

24. The method of claim 22 additionally comprising the step of connecting a screen assembly to the perforating gun assembly before the gun assembly is laterally positioned in the well.

25. The method of claim 22 wherein the perforating gun positioning step comprises connecting the perforating gun assembly to tubing and lowering tubing and assembly into the well.

26. The method of claim 22 additionally comprising the step of setting a packer below the formation prior to perforation of the formation.

27. The method of claim 22 wherein the perforation gun assembling step additionally comprises assembling a locator on the perforating gun assembly and laterally positioning the perforating gun in the well by contacting the packer with the locator.

28. The method of claim 22 additionally comprising the step of centralizing the perforating gun assembly in the well casing during the initiating step.

29. The method of claim 22 additionally comprising the step of radially positioning the perforating gun assembly in the well casing during the initiation step.

30. A method of perforating the subterranean formation of a lateral zone of interest in a cased well with a perforating gun assembly, comprising the steps of:

providing a discontinuous surface in the casing;

providing a perforating gun assembly having a plurality of shaped perforation charges, an initiator coupled to the charges whereby upon actuation the initiator will detonate the charges, a tool having an external surface thereon changeable from a first condition wherein the tool will pass through the casing bore but the external surface will interact with the discontinuous surface in the casing and a second condition wherein the tool will pass through the casing bore and the discontinuous surface in the casing without the external surface on the tool interacting with the discontinuous surface in the casing, and an actuator on the tool is operable in response to complete detonation of the charges to change the tool from the first condition to the second condition;

positioning the perforating gun assembly in the well adjacent to the formation;

initiating the perforating gun assembly to detonate the shaped charges to perforate the formation and operate the actuator in response to complete detonation of the charges to change the tool to the second condition; and moving the perforating gun assembly into the discontinuous surface in the casing whereby movement of the perforating gun assembly through the discontinuous surface is prevented when incomplete detonation of the charges is present.

31. The method of claim 30 wherein the step of providing a discontinuous surface in the casing comprises setting a packer below the formation.

32. The method of claim 30 wherein the tool is a centralizer and wherein the changeable surface moves radially between a first position contacting the walls of the casing to centralize the tool and a second position wherein the changeable surface is radially spaced inward from the first position.

33. The method of claim 32 additionally comprising the step of connecting a screen assembly to the perforating gun assembly before the gun assembly is laterally positioned in the well.

34. The method of claim 32 wherein the perforating gun positioning step comprises connecting the perforating gun assembly to tubing and lowering tubing and assembly into the well.

35. The method of claim 31 wherein the perforation gun assembling step additionally comprises assembling a locator on the perforating gun assembly and laterally positioning the perforating gun in the well by contacting the packer with the locator.

36. A method of operating a tool located in a cased well, comprising the steps of:

providing a tool assembly having an explosive charge, at least one movable part thereon movable between a first position and a second position and an actuator on the tool operable in response to the detonation of the charges to move the movable part from the first position to the second position;

running the tool in the well while the tool is in the first condition; and thereafter initiating the explosive charge to change the tool to the second condition.

37. The method of claim 36 wherein the tool includes a centralizer and wherein the movable part is on the centralizer and moves radially between a first position contacting the walls of the casing to centralize the tool and a second position wherein the movable part is radially spaced inward from the first position.

38. A method of operating a tool located in a cased well, comprising the steps of:

providing a tool assembly having an explosive charge, and a changeable profile movable between a first shape and a second shape and an actuator on the tool operable in response to the detonation of the charge to move the profile from the first shape to the second shape;

running the tool in the well while the tool is in the first shape; and thereafter initiating the explosive to change the tool to the second shape.

39. The method of claim 38 wherein the tool includes a centralizer and wherein the changeable profile is on the centralizer and moves radially between a first position contacting the walls of the casing to centralize the tool and a second position wherein the profile is radially spaced inward from the first position.

40. A perforation gun assembly for use to perforate the subterranean formation of a lateral zone of interest in a cased well wherein the well casing has a restricted bore in the casing below the formation comprising:

a carrier, a plurality of charges on the carrier of the type when detonated will form perforation in the well casing and surrounding formation, at least one tool, the tool being changeable from a first condition wherein the tool will pass through the casing bore but will not pass through the restricted bore and a second condition wherein the tool will pass through the casing bore and the restricted bore; and an actuator on the tool operable in response to the detonation of the charges to change the tool from the first condition to the second condition.

41. The perforation gun assembly of claim 40 wherein the tool is a centralizer.

42. The perforation gun assembly of claim 41 wherein the centralizer has a body and a plurality of pads extending radially from the body in the first condition and wherein the pads are retracted in a radial direction in the second condition.

43. The perforation gun assembly of claim 42 wherein a piston in the body is mounted to move between a first position contacting the pads to hold the pads in the first condition and a second position out of contact with the pads allowing the pads to move to the second condition.

44. The perforations gun assembly of claim 43 wherein springs in the housing contact and urge the pads to move from the first condition to the second condition.

45. The perforation gun assembly of claim 44 wherein a detonator is present in the carrier and a chamber is formed in the housing adjacent to the piston and wherein the chamber is in fluid communication with the detonator.

* * * * *